United States Patent [19]

Watanabe et al.

[11] Patent Number: 4,657,375

[45] Date of Patent: Apr. 14, 1987

[54] PHOTOCOPYING DEVICE WITH SPECIFIED CONDITION CHECKING FUNCTION

[75] Inventors: Junji Watanabe, Yokohama; Masahiko Ogura, Fujisawa, both of Japan

[73] Assignee: Kabushiki Kaisha Toshiba, Kawasaki, Japan

[21] Appl. No.: 629,976

[22] Filed: Jul. 11, 1984

[30] Foreign Application Priority Data

Jul. 18, 1983 [JP] Japan ..... 58-130509
Jul. 25, 1983 [JP] Japan ..... 58-135407

[51] Int. Cl.[4] ..... G03G 15/00
[52] U.S. Cl. ..... 355/14 R
[58] Field of Search ..... 355/14 R, 14 SH, 14 C, 355/23–25, 8

[56] References Cited

U.S. PATENT DOCUMENTS 3,936,180 2/1976 Willard et al. .
4,162,396 7/1979 Howard et al. .
4,173,410 11/1979 Tabata et al. ..... 355/24
4,181,429 1/1980 Batchelor et al. ..... 355/23 Y
4,344,697 7/1982 Matsumoto et al. .
4,436,409 3/1984 Queener ..... 355/14 R

FOREIGN PATENT DOCUMENTS 2838207 5/1979 Fed. Rep. of Germany .
3114703 1/1982 Fed. Rep. of Germany .
59-53827 3/1984 Japan ..... 355/8

OTHER PUBLICATIONS

*IBM Technical Disclosure Bulletin*, vol. 21, No. 11, Apr. 1979, Bach et al., "Copy Quality Check Modes for an Electrophotographic Copier", pp. 4387–4391.

*Primary Examiner*—Arthur T. Grimley
*Assistant Examiner*—J. Pendegrass
*Attorney, Agent, or Firm*—Cushman, Darby & Cushman

[57] ABSTRACT

A copy machine is provided wherein a document on a document table is exposed by an exposure lamp, a toner image is formed on a photosensitive drum by reflected light from the document, and the toner image is transferred and fixed on a copying paper sheet. Half of a document on the document table is copied on an upper surface of a copying paper sheet, and the other half thereof is copied on a lower surface of the sheet. In this case, when a check command is entered in a continuous copying operation mode, the copying operation is interrupted after one copied sheet is obtained and a copied state can be checked. When the copied state is good, the interruption is released by entering another check command so as to restart the copying operation.

7 Claims, 11 Drawing Figures

PHOTOCOPYING DEVICE WITH SPECIFIED CONDITION CHECKING FUNCTION

BACKGROUND OF THE INVENTION

The present invention relates to an image forming apparatus for continuously forming a plurality of identical images.

A copy machine is a typical example of an image forming apparatus of this type. The most advanced copy machine to date has been recently developed. According to this copy machine, copy magnifications can be varied and a desired copy mode (one-side or two-side copy mode) can be selected in addition to the copy number preset function and the selection of different copy paper sizes. In such a copy machine, an operator must select these variable factors before he starts copying a desired document. However, an erroneous preset operation is often performed. For example, when a copy magnification changing mode is set, the desired copy magnification must match the paper size. However, they are often mismatched. This mismatching can be checked by the operator only when the copied sheet is discharged from the copy machine. For this reason, when the copy preset number is large, a number of paper sheets may be wasted. In addition to this disadvantage, the copying operation must be performed again, resulting in lower working efficiency.

A stop key is arranged on a conventional copy machine to stop copying operation. In this case, after one sheet is copied, the operator depresses the stop key to check the output state. However, when the stop key is depressed, the copy preset number data, the copy magnification data, and the copy mode data are cleared. The operator must then preset these data again, resulting in inconvenience. If the operator sets the copy preset number to be 1 and then checks the output state, he must then set the remaining number of sheets to be copied and again depress the start key to obtain these copies, resulting in a cumbersome operation. The above inconvenience also applies to an electronic printer, a facsimile system and the like.

SUMMARY OF THE INVENTION

It is an object of the present invention to provide an image forming apparatus for effectively forming a plurality of identical images wherein an operator can check the forming state of the image at an initial stage of an operation for continuously forming the plurality of identical images.

In order to achieve the above object, there is provided an image forming apparatus for continuously forming a plurality of identical images, comprising input means for entering a check command, interrupting means for, when the check command is entered, interrupting a continuous image forming operation after a predetermined number of images are formed in a continuous image forming mode, and restarting means for restarting to produce the remaining number of images when another check command is entered during an interruption interval in the continuous image forming mode.

According to this image forming apparatus, when the check command is entered, the continuous image forming mode is automatically interrupted when a predetermined number (preferably one) of images are obtained, so that the operator can check the image forming state. In addition, when he enters the check command again, the interruption is released to continue forming the remaining number of images.

DETAILED DESCRIPTION OF THE PREFERRED EMBODIMENT

Figure 1:
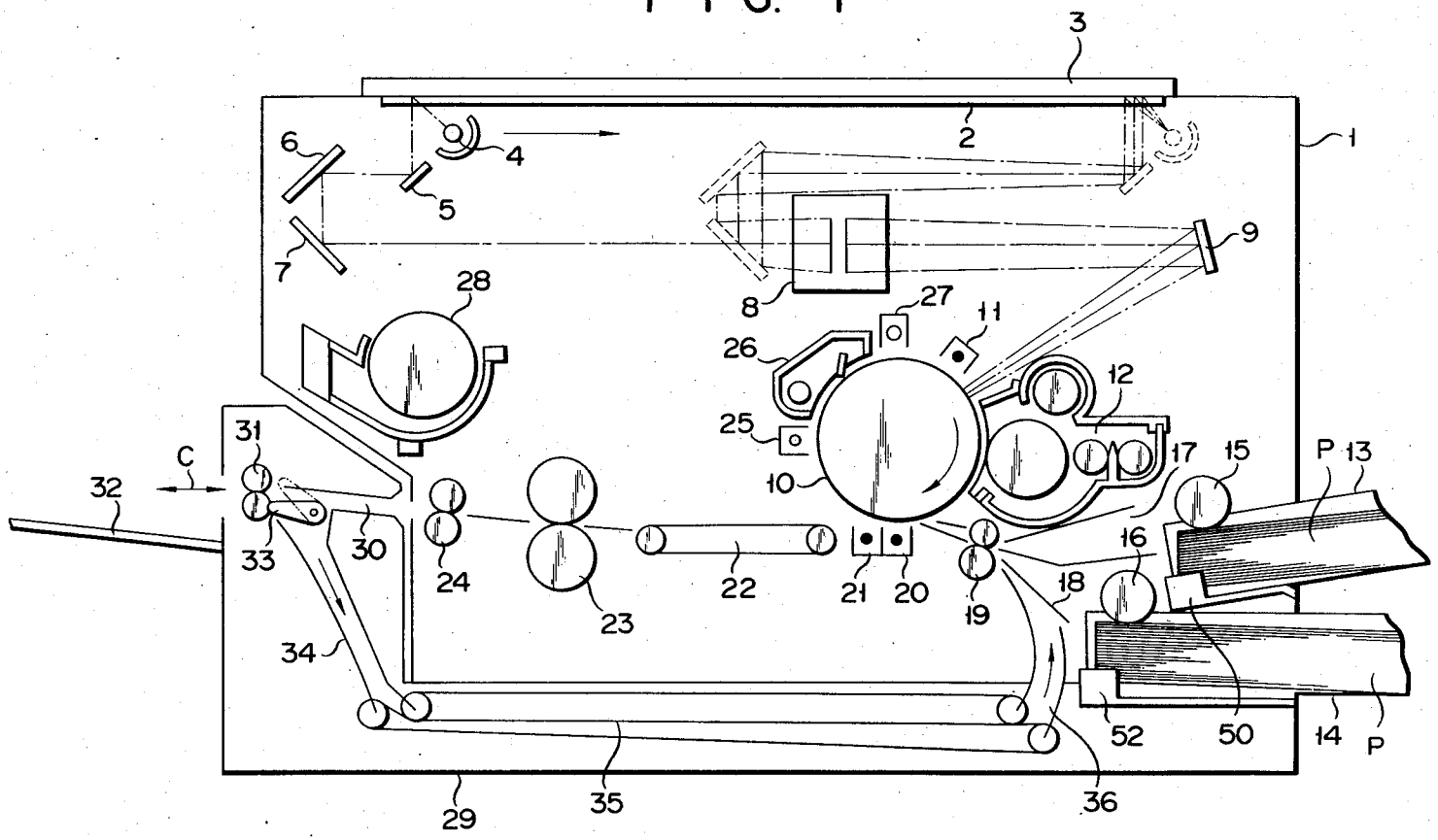
FIG. 1 is a schematic sectional view of a copy machine, which can perform two-side copying, as an embodiment of an image forming apparatus according to the present invention.

An embodiment of an image forming device according to the present invention will now be described with reference to the accompanying drawings. FIG. 1 shows a schematic view of an embodiment of a copy machine which can perform two-side copying. A document table 2 made of transparent glass is fixed on an upper portion of a main body 1 for supporting a document. The document is exposed when an optical system consisting of an exposure lamp 4 and mirrors 5, 6 and 7 is moved in the direction of the arrow along a lower surface of the document table 2. The optical system is normally located at a home position indicated by the solid line and moves for scanning the document by a distance corresponding to a width of the document in response to an exposure start command (or copy start command). In other words, the position indicated by the solid line represents an exposure start position, and a position indicated by the broken line represents an exposure end position. In this case, the mirrors 6 and 7 are moved at half the speed of the exposure lamp 4 and the mirror 5, whereby an optical path length from the document to a photosensitive drum 10, described later, is kept constant. Light from the mirror 7 is incident on an axial portion of a surface of the photosensitive drum 10 through a magnification changing lens block 8 (used when changing a copying magnification), a mirror 9, and a slit (not shown).

First, the photosensitive drum 10 is positively charged by a charger 11, while the drum 10 is rotated in a clockwise direction indicated by the arrow in synchronism with document exposure by the optical system. Then, the photosensitive drum 10 is slit-exposed by reflected light from the document, and an image of the document is formed as an electrostatic latent image on a surface of the drum 10. A developer or developing unit 12 negatively charges toner, and the toner is then attached to the latent image on the photosensitive drum 10 so as to form a toner image, i.e., visible image. In this embodiment, copying paper sheets of various sizes are stored in corresponding paper feed cassettes which are detachable from the main body 1, so that copying on various sized paper sheets can be made. Accordingly, the paper feed cassettes can be changed if desired. Furthermore, in this embodiment, two paper feed cassettes 13 and 14 can be simultaneously loaded. One of the paper feed cassettes 13 and 14 is selected by operation of an operation panel to be described later. Copying paper sheets P are fed one by one by a corresponding feed roller 15 or 16 from the selected paper feed cassette 13 or 14. Then, the copying paper sheet P is conveyed along a guide path 17 or 18 to an aligning roller pair 19. Then, a feed timing of the copying paper sheet P is synchronized with a rotation of the photosensitive drum 10 and the sheet is conveyed into a space between the photosensitive drum 10 and a transfer unit 20. When an operator selects a cassette, he merely selects the upper or lower cassette, but does not know the size of the copying paper therein. Therefore, cassette size sensors 50 and 52 are provided near respective cassette insertion ports in order to display the size of the copying paper in the selected cassette on the operation panel. The cassette size sensors 50 and 52 consist of a plurality of microswitches which are turned on/off corresponding to the size of the cassette.

The copying paper sheet P conveyed into the space between the photosensitive drum 10 and the transfer unit 20 is brought into tight contact with the photosensitive drum 10 and is rotated therewith. The copying paper sheet P is positively charged by the transfer unit 20, and the toner image on the photosensitive drum 10 is transfered thereto. The paper sheet having the transferred image thereon is separated from the photosensitive drum 10 by a separating unit 21 and is conveyed by a transfer belt 22 into a space between a pair of fixing rollers 23. Heat and pressure are applied to the copying paper sheet P by the fixing roller pair 23 so as to fix the transferred toner image thereon. Thereafter, the paper sheet with the fixed image thereon is discharged by a discharging roller pair 24 from the main body 1. The photosensitive drum 10 from which the copying paper sheet is separated is discharged by a discharger 25, and thereafter residual toner on the drum 10 is removed from the surface thereof by a cleaner 26. Furthermore, a residual charge is erased by a discharge lamp 27 so as to set the photosensitive drum 10 in an initial state. In order to prevent the temperature of the main body becoming abnormally high, a cooling fan 28 is provided near the discharging roller pair 24.

In a lower portion of the main body 1, a two-side copying unit 29 is detachably arranged for conveying a copied paper sheet discharged from the main body 1 back to a paper feed side for two-side copying. This two-side copying unit 29 comprises a guide path 30 along which the copied paper sheet discharged from the main body 1 is conveyed by the discharging roller pair 24, an inverting roller 31 for discharging the copied paper sheet from the guide path 30 to a discharging tray 32 in a forward rotation mode and for conveying it toward a guide path 34 in a reverse rotation mode, a gate 33 for selectively opening/closing a path between the guide path 30 and the inverting roller 31, a convey path 35 for conveying the copied paper sheet from the guide path 34 toward the paper feed side, and a guide path 36 for conveying the copied paper sheet from the convey path 35 to the aligning roller pair 19. When the obversepresented copied paper sheet is fed to the aligning roller pair 19 for the second time, it is inverted by the guide path 36.

Figure 2:
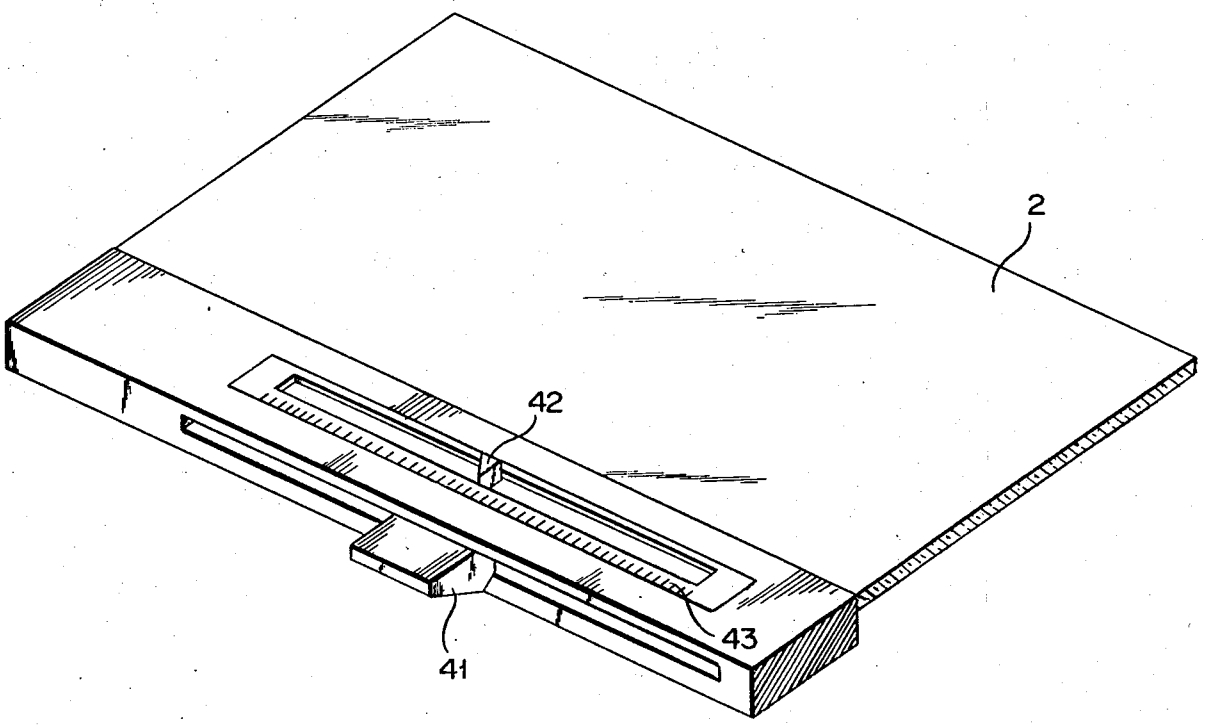
FIG. 2 is a perspective view of a document table of the copy machine.

FIG. 2 shows a simplified perspective view of the document table 2. In this embodiment, as described later, a document on the document table 2 can be treated as two documents and can then be scanned twice (it is referred as a two-time exposure mode hereafter). This is particularly suitable for bound documents such as books and notebooks. In the two-time exposure mode, an operator can freely set a dividing position (i.e., dividing line) of scanning by using a slide lever 41 which can move in a transverse direction (i.e., right and left in FIG. 1). The slide lever 41, a pointer 42 for indicating the dividing position in synchronism with the slide lever 41, and a scale 43 for the pointer 42 are provided at the front side of the document table 2 (i.e., the side shown in FIG. 2).

Figure 3:
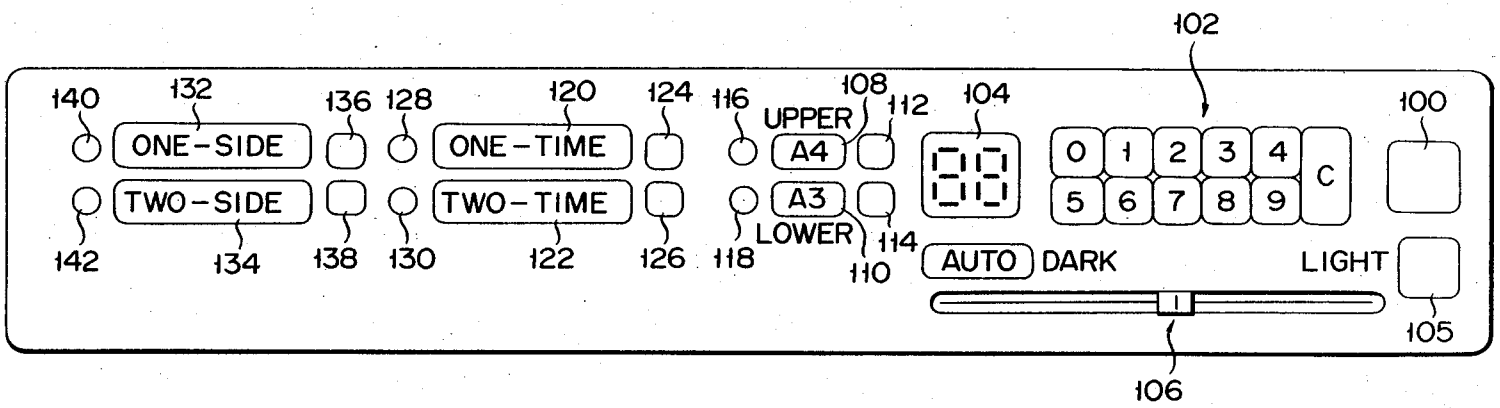
FIG. 3 is a plan view of an operation panel arranged near the document table of the copy machine.

FIG. 3 shows a plan view of an operation panel provided near the document table 2 of this embodiment for entering various commands. On the operation panel, a start key 100, a copying sheet number preset key 102, and a copied sheet number display 104 are sequentially arranged from the right end thereof. A check key 105 as a main feature of the present invention is provided below the start key 100. A density preset key 106 for controlling copying density is provided below the copying sheet number preset key 102 and the copied sheet number display 104. At the left of the copied sheet number display 104, paper size selection keys 112 and 114 for selecting the upper or lower cassette, displays 108 and 110 for displaying sizes of the corresponding cassettes, and lamps 116 and 118 for indicating the selection result are sequentially provided. Furthermore, at the left of these, keys 124 and 126 for selecting whether a document on the document table 2 is treated as one or two, displays 120 and 122 for displaying whether the document is exposed in a one-time or two-time exposure mode, and lamps 128 and 130 for indicating the selection result thereof are sequentially provided. Furthermore, at the left of these, keys 136 and 138 for selecting whether a one-side or two-side copying mode is performed, displays 132 and 134 for displaying whether the one-side or two-side copying mode is selected, and lamps 140 and 142 for indicating the selection result thereof are sequentially provided.

Figure 4:
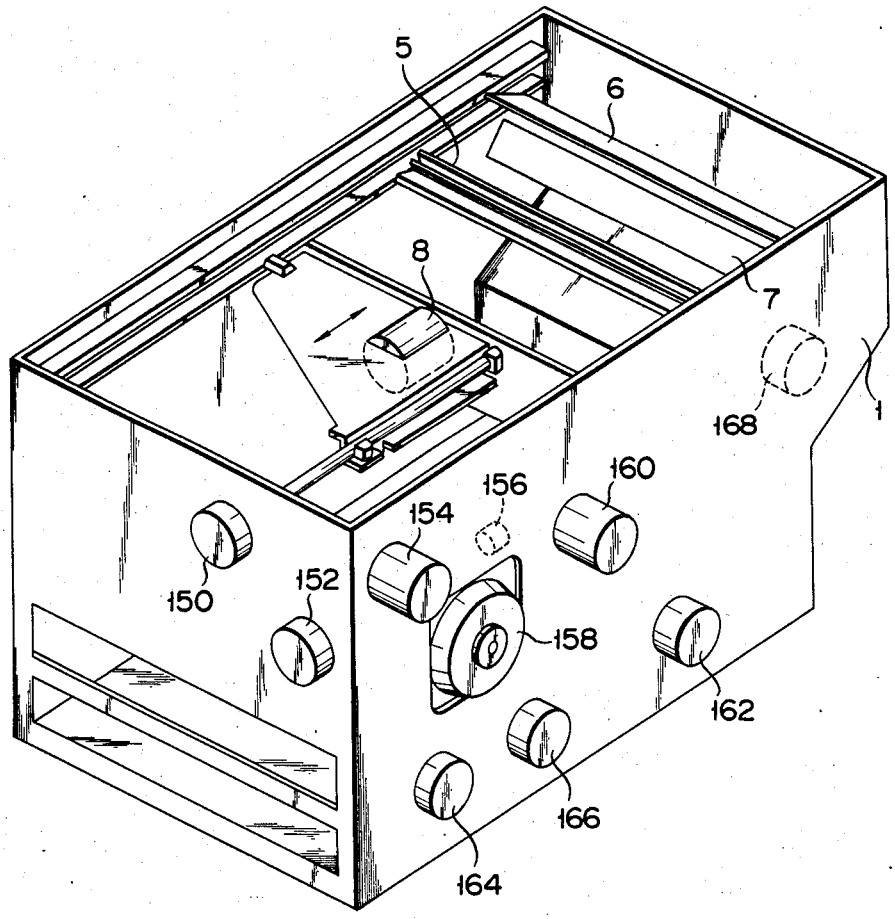
FIG. 4 is a view for showing an arrangement of pulse motors serving as driving sources.

FIG. 4 shows an allocation of drive sources made of pulse motors. The drawing of FIG. 4 is depicted as if viewed from the rear side of the copy machine, although the FIG. 1 drawing shows the front side of the copy machine. A magnification changing motor 150 is provided for changing the location of the magnification changing lens block 8. The motor 152 changes the distance (optical path) between the mirror 5 and the mirror 6 when the copy magnification is changed. A scanning motor 154 moves the exposure lamp 4 and the mirrors 5, 6 and 7 for scanning the document. A shutter motor 156 moves the shutter (not shown) to adjust the charging width of the charge on the photosensitive drum 10 formed by the charger 11 when the copy magnification is changed. A developing motor 158 drives the developing roller of the developer 12. A drum motor 160 drives the photosensitive drum 10. A fixing motor 162 drives the transfer belt 22, the fixing roller pair 23, and the discharge roller pair 24. A paper feed motor 164 drives the feed rollers 15 and 16. A paper feed motor 166 drives the aligning roller pair 19. A fan motor 168 drives the cooling fan 28.

Figure 5:
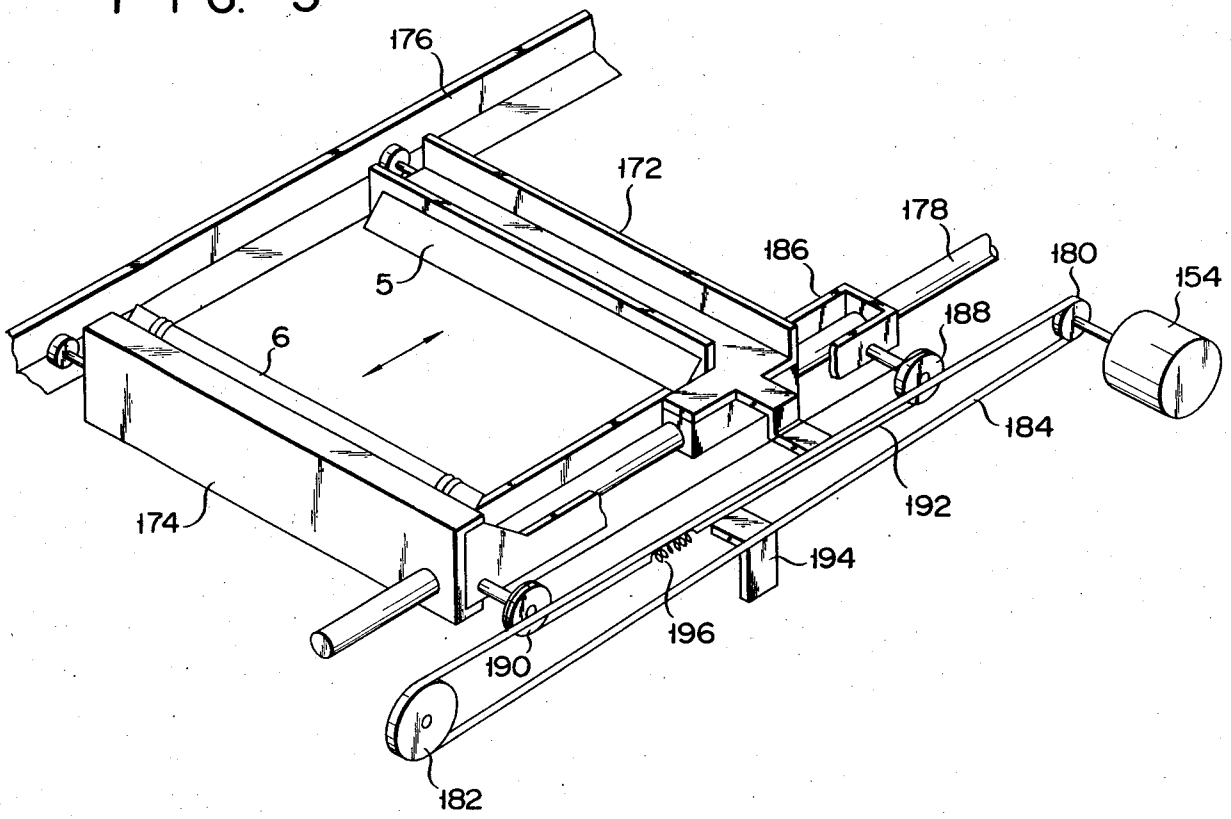
FIG. 5 is a perspective view of a scanning mechanism for moving an optical system.

FIG. 5 shows a scanning mechanism for moving the optical system comprised of the exposure lamp 4 and the mirrors 5, 6 and 7 along the document table 2. The mirror 5 and exposure lamp 4 are supported by a first carriage 172; the mirrors 6 and 7 are supported by a second carriage 174. These carriages 172 and 174 can move in the direction of the arrow along with guide rails 176 and 178. The scanning motor 154 has a 4-phase pulse motor which drives a pulley 180. An endless belt 184 is wound around this pulley 180 and an idle pulley 182. The first carriage 172 supporting the mirror 5 is fixed at one end to the mid portion of the endless belt 184. A couple of rotatable pulleys 188 and 190 are mounted to a guide 186 of the second carriage 174. The pulleys 188 and 190 are covered with a wire 192. One end of the wire 192 is fixed to a fixing piece 194, while the other end is fixed to the fixing piece 194 via a coiled spring 196. One end of the first carriage 172 is fixed to the mid-portion of the wire 192. With the rotation of the pulse motor 154, the belt 184 rotates causing the first carriage 172 to move. In turn, the second carriage 174 also moves. At this time, the pulleys 188 and 190 serve as a fall block. Therefore, the second carriage 174 moves at half of the speed of the first carriage 172 while traveling in the same direction as the first carriage 172. The moving direction of the first and second carriages 172 and 174 can be changed by reversing the rotating direction of the pulse motor 154.

Figure 6:
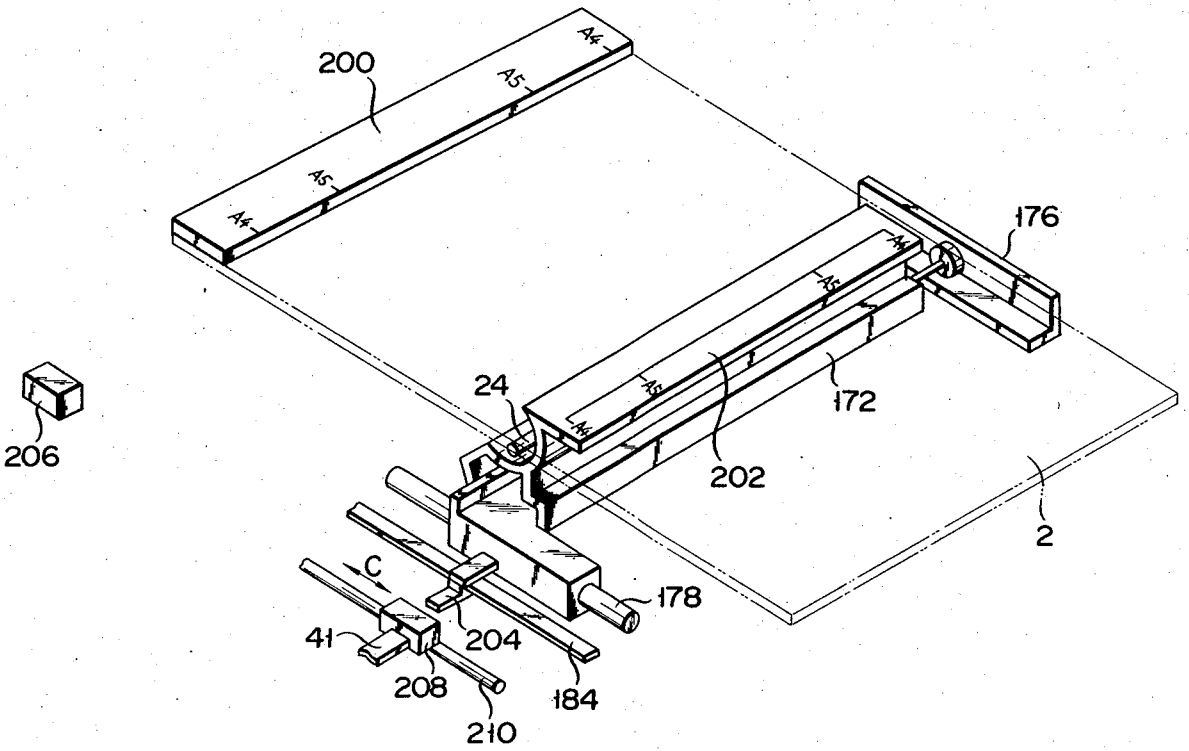
FIG. 6 is a view for showing a relationship between the scanning mechanism of the optical system shown in FIG. 5 and a slide lever shown in FIG. 2.

FIG. 6 shows a view for explaining a relationship between the scanning mechanism of the optical system shown in FIG. 5 and the slide lever 41 shown in FIG. 2. At the left end (also left in FIG. 1) of the document table 2, a scale 200 is provided to represent a copy length corresponding to each size of the copying paper sheets. A scale 202 representing a copy length is also provided on an upper portion of the first carriage 172 shown in FIG. 5. A magnet 204 moving with the first carriage 172 is fixed on the endless belt 184. Reed switches 206 and 208 are provided within a moving range of the magnet 204. The reed switch 206 is fixed at the left end of the document table 2, i.e., at the first exposure start position. The reed switch 208 is movably arranged on a rod 210 along the endless belt 184, and the position thereof is determined by the slide lever 41 shown in FIG. 2. In other words, the position of the reed switch 208 is the position of the pointer 42, i.e., the first exposure end position (or second exposure start position).

Figure 7:
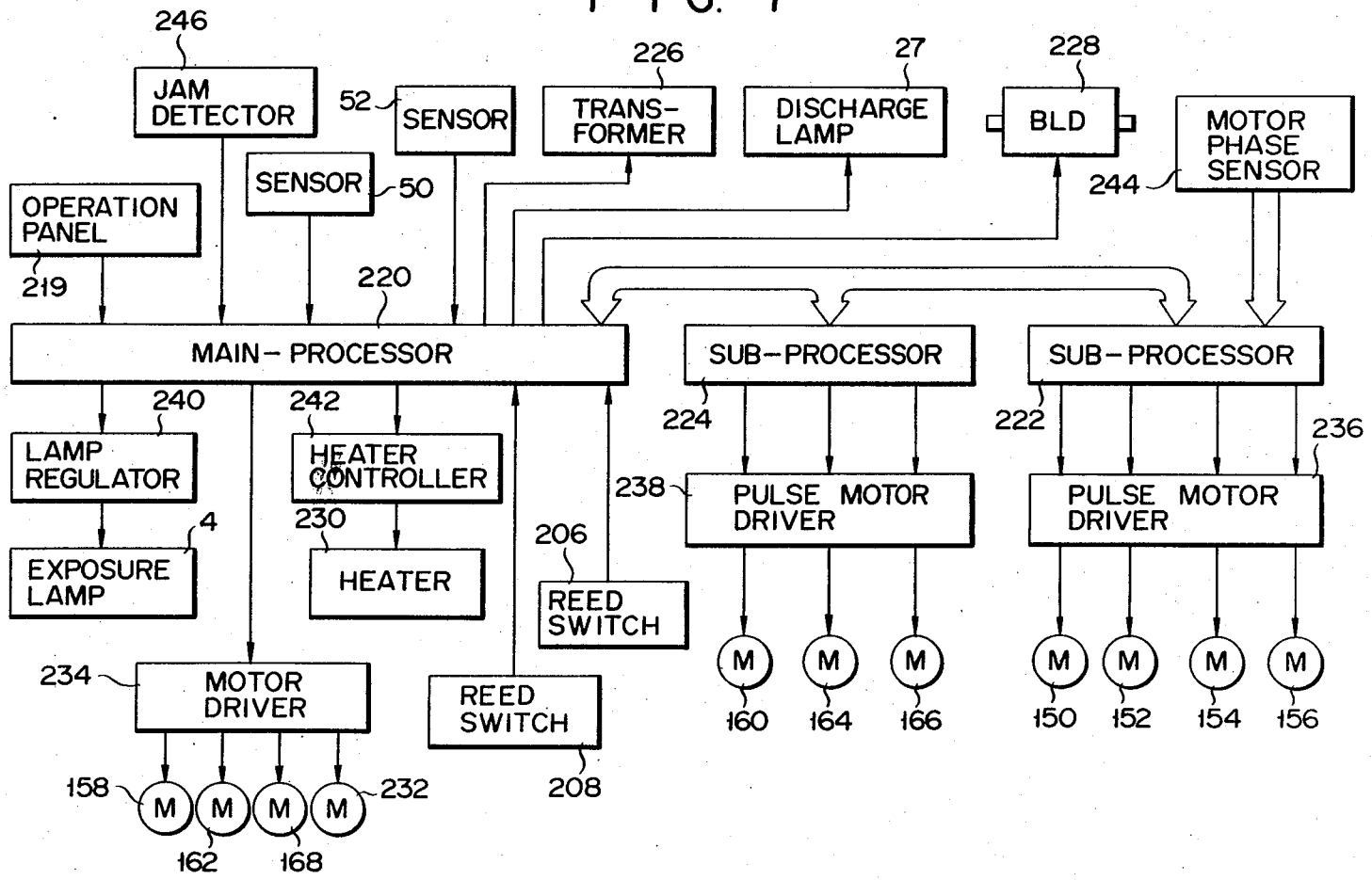
FIG. 7 is a block diagram of a control system of the embodiment.

Turning now to FIG. 7, there is illustrated the overall control system of the present embodiment. As shown, the control system comprises a main processor 220 and first and second sub-processors 222 and 224. The main processor 220 detects signals from the operation panel 219 and the cassette size sensors 50 and 52 and controls a high voltage transformer 226, a discharge lamp 27, a blade solenoid (BLD) 228 of the cleaner 26, a heater 230 of the fixing roller pair 23, an exposure lamp 4, and motors 150 to 168. Of those motors 150 to 168, the motors 158, 162 and 168 and a motor 232 for supplying toner to the developer 12 are controlled by the main processor 220 through a motor driver 234. The motors 150, 152, 154 and 156 are controlled by the first sub-processor 222 through a pulse motor driver 236, and the motors 160, 164 and 166 are controlled by the second sub-processor 224 through a pulse motor driver 238. The exposure lamp 4 is controlled by the main processor 220 through a lamp regulator 240. A heater 230 is controlled by the main processor 220 through a heater controller 242. The main processor 220 sends motor drive and stop commands to the first and second sub-processors 222 and 224. These sub-processors 222 and 224 send status signals representing the drive and stop of the motors to the main processor 220. The main processor 220 is also connected to a jam detector 246 on the transfer path. The first sub-processor 222 is supplied with position date from a motor phase sensor 244 for detecting the initial position of each of the motors 150, 152, 154, and 156. The output signals from the reed switches 206, 208 are supplied to the main processor 220.

Figure 8:
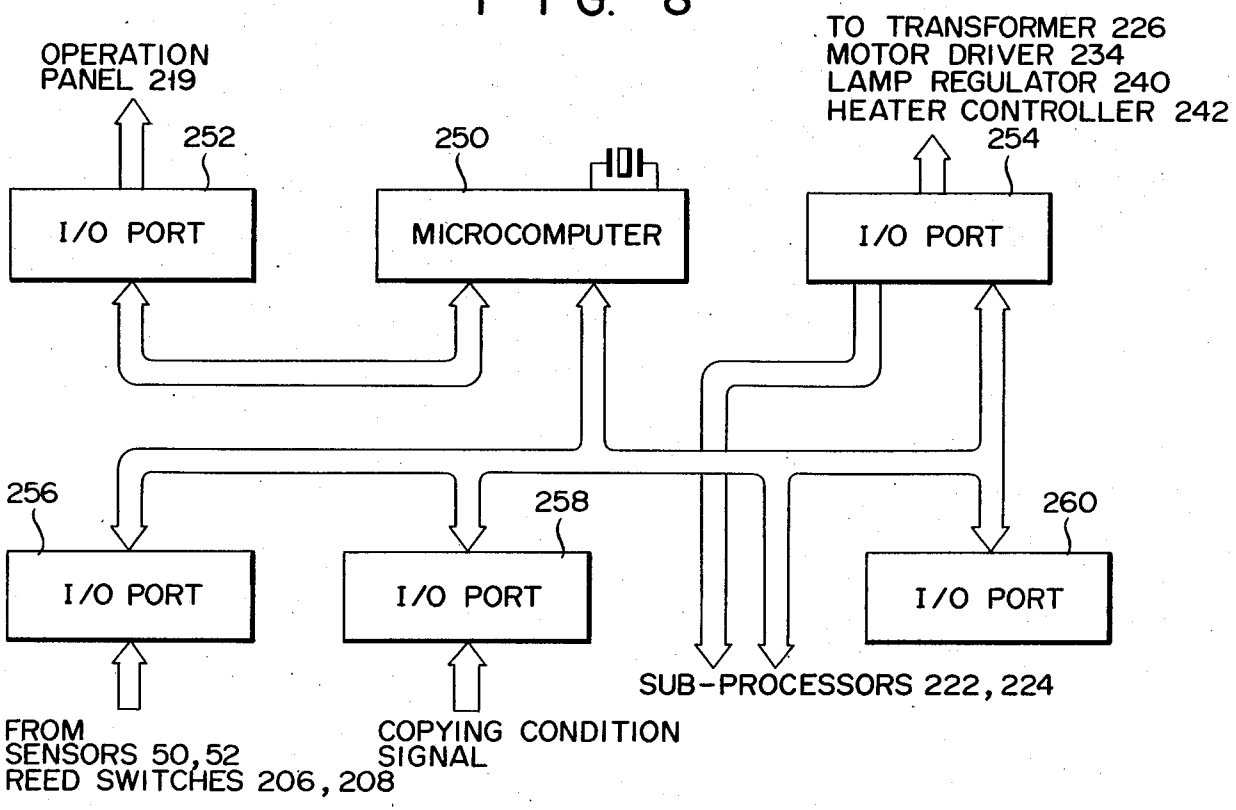
FIG. 8 is a block diagram showing a configuration of a main processor shown in FIG. 7.

FIG. 8 shows an arrangement of the main processor 220. A microcomputer 250 detects key-in signals from the operation panel 219 through an I/O port 252 and controls various displays. The microcomputer 250 is provided with I/O ports 254, 256, 258 and 260. The I/O port 254 is coupled with the transformer 226, the motor driver 234, the lamp regulator 240, and the heater controller 242. The I/O port 256 is coupled with the cassette size sensors 50 and 52 and the reed switches 206 and 208, and the I/O port 258 receives the copy condition set signal. The I/O port 260 is optionally used.

Figure 9:
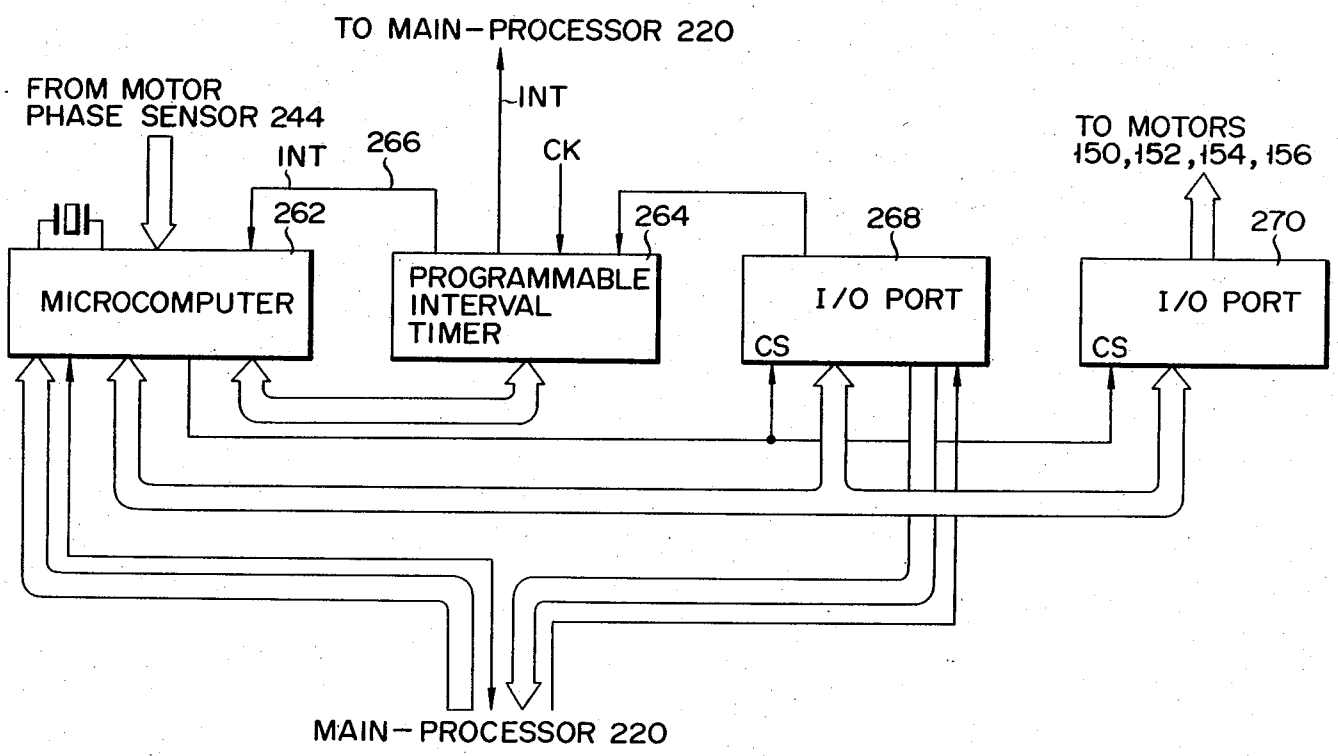
FIG. 9 is a block diagram showing a configuration of a first sub-processor shown in FIG. 7.

FIG. 9 shows a schematic illustration of the first sub-processor 222. A microcomputer 262 is connected to the main processor 220. A programmable interval timer 264 is provided to control the phase switching of the pulse motor. The microcomputer 262 sets a set value of the programmable interval timer 264. Then, the programmable interval timer 264 starts the counting operation and produces an end pulse to an interrupt line 266 of the microcomputer 262 when the count value reaches the set value. A reference clock pulse CK is input to the programmable interval timer 264. The microcomputer 262 receives the position data from the motor phase sensor 244 and is connected to I/O ports 268 and 270. The motors 150, 152, 154, and 156 are connected through the pulse motor driver 236 to the I/O port 270. The I/O port 268 outputs the status signal of each pulse motor to the main processor 220.

Figure 10:
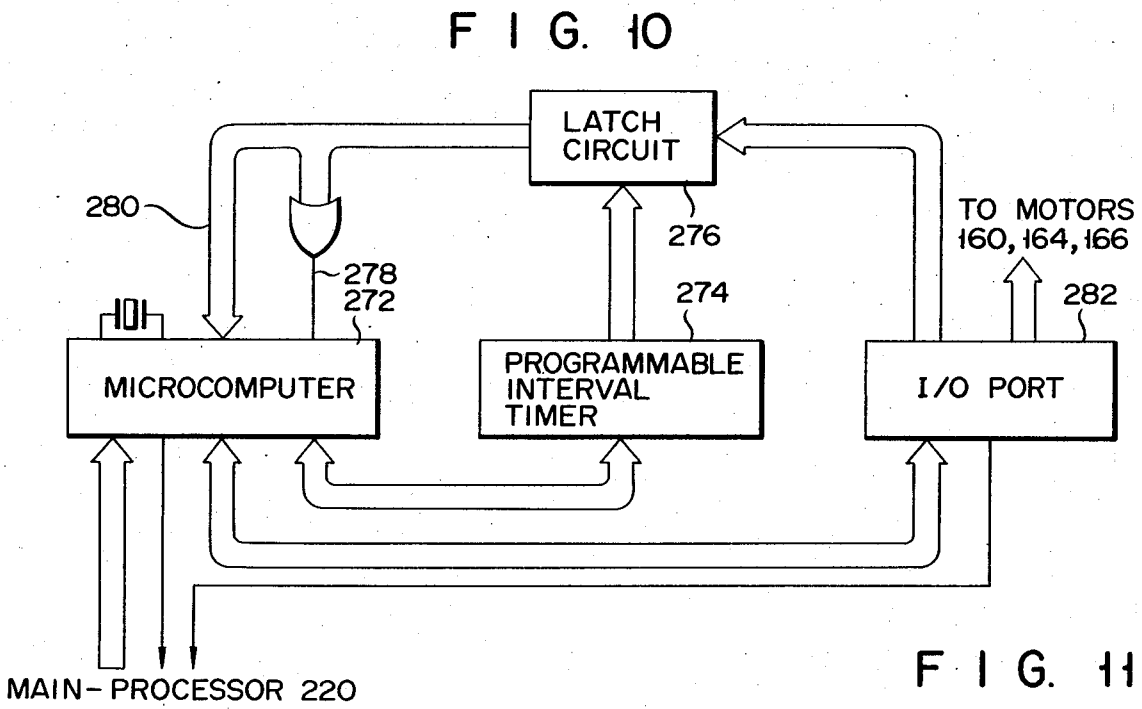
FIG. 10 is a block diagram showing a configuration of a second sub-processor shown in FIG. 7.

The arrangement of the second sub-processor 224 is shown in FIG. 10. A microprocessor 272 is connected to the main processor 220. A programmable interval timer 274 controls the time intervals for phase switching of the pulse motor. The microcomputer 272 sets a set value of the programmable interval timer 274. The programmable interval timer 274 produces an end pulse when the count value reaches the set value. The end pulse is latched in a latch circuit 276 of which the output is supplied to an interrupt line 278 of the microcomputer 272 and an input line 280. The microcomputer 272 is connected to an I/O port 282. The motors 160, 164 and 166 are connected through the pulse motor driver 238 to the I/O port 282.

Next, the operation of the copy machine of this embodiment will be described. The copy machine of this embodiment has various operation modes, and each operation mode will now be described. A one-side or two-side copying mode is selected corresponding to whether an image is to be formed on one or both sides of the copying paper sheet. The one-side copying mode is selected by depressing the key 136 of the operation panel (FIG. 3). In this case, the gate 33 opens the path between the guide path 30 and the inverting roller 31, as shown in FIG. 1. The one-side copied paper sheet is immediately discharged toward the discharging tray 32 when the inverting roller 31 is rotated in a forward direction. On the other hand, the two-side copying mode is selected by depressing the key 138 of the operation panel. In this case, when the copied paper sheet is passed through the gate 33, the gate 33 closes the path between the guide path 30 and the inverting roller 31. Thereafter, the inverting roller 31 is rotated in a reverse direction and the copied paper sheet is conveyed back to the aligning roller pair 19 through the guide path 34, the convey path 35 and the guide path 36. In this case, the one-side copied paper sheet is inverted by the guide path 36 to present the other side thereof, on which no image is formed, toward the photosensitive drum 10, whereby two-side copying can be performed.

The one-time or two-time exposure mode is selected corresponding to whether the document on the document table 2 is to be treated as one or two documents. The one-time exposure mode is selected by depressing the key 124 of the operation panel. When the operator depresses the start key 100, the optical system is moved to the right by a predetermined distance from the exposure start position, indicated by the solid line in FIG. 1, in order to scan the document. This predetermined distance is equal to a width of the copying paper sheet stored in the selected paper feed cassette. On the other hand, the two-time exposure mode is selected by depressing the key 126 of the operation panel. Then, by using the slide lever 41, the operator sets a dividing position (dividing line) along which the document is to be divided into two portions, corresponding to the size of e.g., a book or a notebook. When the operator depresses the start key 100, the optical system is moved to the right from the exposure start position for scanning the document. In this case, a moving distance of the optical system corresponds to that between the exposure start position and a position of the slide lever 41. When the first scanning operation is finished and an image on the photosensitive drum 10 is transferred to the copying paper sheet, the optical system is moved from the first exposure end position by the same distance as that of the first scanning operation so as to perform the second scanning.

When the number of the copying paper sheets is set at two or more and an operator depresses the key 105, a check mode is selected.

Figure 11:
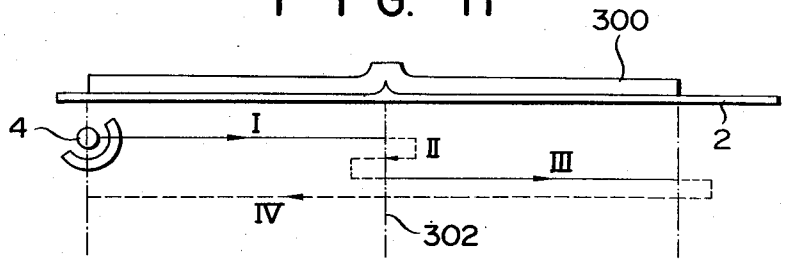
FIG. 11 is a schematic view for explaining a movement of the optical system in a two-side copying mode.

An example of the operation of this embodiment will be described, wherein two pages of an opened book are copied on both sides of each of a plurality of copying paper sheets, and the check mode is selected. Note that the copy magnification is set at 1, giving an equal size image. An operator puts an opened book 300 on the document table 2, as shown in FIG. 11. The left end of the book 300 is in contact with the scale 200 provided at the left end of the document table 2. A longitudinal position of the book 290 is determined corresponding to a division of the scale 200. Then, the position of the slide lever 41 is set at the position of a gutter 302 of the book 300. The reed switch 208 is moved to the position corresponding to that of the slide lever 41. Then, the operator enters the number of the copying paper sheets by depressing the copying sheet number preset key 102. Then, the operator sequentially selects the two-time exposure mode and the two-side copying mode by depressing the corresponding keys 126 and 138. Subsequently, the operator determines a size of the copying paper sheet corresponding to that of one page of the book 300, and inserts the paper feed cassette, in which the copying paper sheets of the selected size are stored, into the main body 1. Thereafter, the operator selects the desired cassette by depressing the key 112 or 114, and then sequentially depresses the check key 105 and the start key 100.

When the start key 100 is depressed, the exposure lamp 4 is illuminated to yield a sufficient amount of light. Thereafter, the scanning motor 154 is rotated in the forward direction (i.e., clockwise in FIG. 5), and the optical system is moved to the right as indicated by the arrow I of FIG. 11 so as to expose the first page of the book 300. The optical system is moved until the reed switch 208 is turned on. Although the reed switch 208 is at the first exposure end position 302, the motor 154 is slightly over-driven and then stopped because of its inertia. In synchronism with this exposure, the photosensitive drum 10 is rotated in the clockwise direction, and then the first page of the book 300 is copied on the obverse surface of the copying paper sheet fed from the paper feed cassette. The fixed copied paper sheet is discharged toward the discharging tray 32 by the inverting roller 31. In this case, the copying paper sheet is not completely discharged, that is, it is stopped in the state where the trailing end thereof is clamped by the inverting roller 31. Thereafter, when the inverting roller 31 is rotated in the reverse direction, the copying paper sheet is conveyed and inverted through the guide path 34, the convey path 35, and the guide path 36 and is supplied to the aligning roller pair 19 again. Then, the reverse surface of copying paper sheet is set in the copying waiting mode thereof.

Thereafter, the scanning motor 154 is slightly rotated in the reverse direction (i.e., counter-clockwise in FIG. 5) so as to move the optical system to the left as indicated by the arrow II of FIG. 11. Therefore, the optical system is returned to the second exposure start position, i.e., first exposure end position 302. Then, the exposure lamp 4 is illuminated to yield the sufficient amount of light again, and the scanning motor 154 is rotated in the forward direction so as to move the optical system to the right, as indicated by the arrow III of FIG. 11, thereby exposing the second page of the book 300. The document of the second page is copied on the copying paper sheet waiting at the aligning roller pair 19 (i.e., if the first page is copied on an upper surface of the copying paper sheet, the second page is copied on a lower surface thereof). The two-side copied paper sheet is discharged from the inverting roller 31 toward the discharging tray 32. Every time a copied paper sheet is discharged to the discharging tray 32, the preset copied sheet number counter is decreased by 1.

In the case when the number of the copied paper sheet is set at two or more and the check mode is selected, when the first copied paper sheet is discharged to the discharging tray 32, the operation is automatically interrupted. In this case, the copied sheet number counter or various modes entered from the operation panel are not reset. The operator can check the output state, for example, whether or not the document is correctly set on the document table, whether or not the size of the copying paper sheet corresponds to that of the document, whether or not the copying density is appropriately set, or the like. When the output state is satisfactory, the operator depresses the check key 105 again. Then, the interrupted copying operation is resumed. Thereafter, the copying operation described above is repeated until the preset number of the copied sheet number counter is decreased to zero, and the preset number of copied paper sheets can be obtained. When the check mode is not selected, this interruption interval after forming the first copy is omitted. Note that, after the interruption, when the operator depresses not the check key 105 but the start key 100, the operation is interrupted again after the next copied sheet is formed, as described above. This interruption is for checking the output state adjusted during the first interruption interval when the initial copying condition was not satisfactory.

The operation of this embodiment is not limited to the above example, but may also be used when each page of a book is to be copied on only one side of the copying paper sheets, or when a normal paper sheet is used as a document instead of a book.

In this manner, according to the present invention, when an operator depresses a check key arranged on an operation panel before the copying operation starts, the copying operation is interrupted after the first copy is formed, and the operator can check the output state. Furthermore, when the output state is satisfactory, the operator simply depresses the check key again to continue the remaining copying operation. Therefore, it is not necessary to enter the various modes from the operation panel again. Accordingly, a plurality of copies can be effectively produced without wasting time or copying paper sheets.

The present invention is not limited to this embodiment, but can be modified. Although the copying operation is interrupted after one copied sheet is obtained in the embodiment described above, the number of copied sheets for checking is not limited to one, for example. In addition, it is not necessary that a dividing point in the two-time exposure mode be variable, and it can be automatically determined by the size of the copying paper sheets. In this case, an exposure distance for each copying operation is determined by a width of the copying paper sheet. The present invention may be employed in a copy machine which has no two-side copying mechanism. It is not necessary to provide the check key for selecting the check mode. In other words, another key, such as an interrupt key, may serve as the check key described above. Furthermore, an image forming device is not limited to only a copying machine, but may also include an electronic printer, a facsimile system and the like.

What is claimed is:

1. A copying device comprising:

a photosensitive body;

a document table for supporting a document, said document table including means for defining a dividing line, said document supported by said table being divided into first and second pages by said dividing line, a position of said dividing line being changeable;

exposing means for exposing a document supported on said document table and for froming an image of the document on said photesensitive body, said exposing means initially exposing the first and second pages of said document at a time of a first and second exposure, respectively, to form images of said first and second pages on said photosensitive body at the time of said first and second exposures, respectively;

transfer means for transferring the image formed on said photosensitie body to a copying sheet;

copy number inputting means for inputting a predetermined number of copies;

copy start command inputting means for inputting a start command;

check command inputting means for inputting a check command; and copying operation control means for interrupting a copying operation after a preset number of copies are obtained if the check command has been input, and for restarting the copying operation to obtain a number of copies equal to the difference between the inputted predetermined number of copies and the preset number of copies in response to input of the check command again during the time the copying operation is interrupted.

2. A copying device according to claim 1, wherein said preset number is one.

3. A copying device according to cliam 1, wherein said check command inputting means inputs the check command before the start command is input.

4. A device according to claim 1, further including slide switch means, coupled to said document table, for setting the position of said dividing line.

5. A copying device according to claim 1, wherein said transfer means transfers the images of said first and second pages of said document formed on said photosensitive drum to the face and the back, respectively, of the copying sheet.

6. A copying device according to claim 1, in which said copying operatin control means restarts the copying operation to obtain the inputted predetermined number if said copy start command is input during the time the copying operation is interrupted and interrupts the restarted copying operation after the preset number of copies is again obtained.

7. A copying device according to claim 1, in which images of the first and second pages of said document are transferred to one side of a further respective copying sheets.

* * * * *